US011757263B2

(12) United States Patent
Miller et al.

(10) Patent No.: US 11,757,263 B2
(45) Date of Patent: Sep. 12, 2023

(54) SPARK PLUG GAPPING TOOL

(71) Applicant: GP Productions LLC, Newbury Park, CA (US)

(72) Inventors: Patrick Miller, Newbury Park, CA (US); Griffin Steinfeld, Newbury Park, CA (US)

(73) Assignee: GP PRODUCTIONS LLC, Newbury Park, CA (US)

( * ) Notice: Subject to any disclaimer, the term of this patent is extended or adjusted under 35 U.S.C. 154(b) by 0 days.

(21) Appl. No.: 18/099,331

(22) Filed: Jan. 20, 2023

(65) Prior Publication Data

US 2023/0155355 A1 May 18, 2023

Related U.S. Application Data

(63) Continuation of application No. 17/210,935, filed on Mar. 24, 2021, now Pat. No. 11,563,309.

(51) Int. Cl.
*H01T 21/06* (2006.01)
*B25B 7/04* (2006.01)

(52) U.S. Cl.
CPC ..... *H01T 21/06* (2013.01); *B25B 7/04* (2013.01)

(58) Field of Classification Search
CPC ..... H01T 21/06; B25B 7/04
USPC ..... 72/476
See application file for complete search history.

(56) References Cited

U.S. PATENT DOCUMENTS

| | | | | |
|---|---|---|---|---|
| 2,492,380 | A * | 12/1949 | Duma | H01T 21/06 72/477 |
| 2,581,439 | A | 1/1952 | Pentland | |
| 2,645,142 | A | 7/1953 | Schwenzfeier | |
| 2,670,643 | A | 3/1954 | Clark | |
| 2,871,741 | A | 2/1959 | Weisbecker et al. | |
| 3,898,829 | A * | 8/1975 | Sydow | H01T 13/24 72/457 |
| 4,070,898 | A * | 1/1978 | Earle | F02P 17/00 72/409.13 |
| 9,929,544 | B1 | 3/2018 | Swords | |
| 2016/0105002 | A1 | 4/2016 | Desalvo | |

OTHER PUBLICATIONS

Gapping Pliers Instructions, Part No. 380700, ACCEL, 2006.

* cited by examiner

*Primary Examiner* — Christopher M Raabe
(74) *Attorney, Agent, or Firm* — Akerman LLP

(57) ABSTRACT

According to one example, a spark plug gapping tool includes a first side handle, a second side handle, a middle handle, and a pusher that are made of a non-metallic material. The middle handle is positioned in-between the first side handle and the second side handle, and has a stopper surface and an insert slot that can receive a feeler gauge insert. The pusher is rotatably positioned in-between the first side handle and the second side handle, and has a hollow housing that can receive a terminal end of a spark plug. In operation, a distal end of the middle handle and distal ends of the side handles can move closer together, when a proximal end of the middle handle and proximal ends of the side handles are moved closer together by a user's hand, so as to gap the spark plug.

19 Claims, 8 Drawing Sheets

SPARK PLUG GAPPING TOOL

CROSS-REFERENCE TO RELATED APPLICATIONS

This application is a continuation of U.S. application Ser. No. 17/210,935, filed Mar. 24, 2021, the entire contents of which are hereby incorporated by reference.

TECHNICAL FIELD

This disclosure relates generally to the field of tools and more specifically to a spark plug gapping tool.

BACKGROUND

A spark plug is a device that produces a spark for igniting a combustible mixture (e.g., a compressed fuel/air mixture in an engine of an automobile). This spark is produced when an electrical current flows from a center electrode to a side electrode, across a spark plug gap in-between the center electrode and the side electrode. The distance of this spark plug gap (i.e., the distance between the center electrode and the side electrode) is important to the operation of the spark plug. Furthermore, this spark plug gap distance frequently needs to be changed prior to the spark plug being installed. This process of changing the spark plug gap distance is referred to as gapping the spark plug. Unfortunately, traditional methods and tools for gapping a spark plug may be deficient.

SUMMARY

According to one example, a spark plug gapping tool includes a first side handle, a second side handle, a middle handle, and a pusher that are made of a non-metallic material. The first side handle extends from a proximal end to a distal end, and has a first connection opening that extends through a first standoff protrusion, a second connection opening, and a third connection opening. The second side handle extends from a proximal end to a distal end, and has a first connection opening that extends through a first standoff protrusion, a second connection opening, and a third connection opening. The middle handle extends from a proximal end to a distal end, and is positioned in-between the first side handle and the second side handle. The middle handle has a first connection opening that can receive the first standoff protrusion of the first side handle and the first standoff protrusion of the second side handle. The middle handle also has a stopper surface, and an insert slot that can receive a feeler gauge insert. The pusher is rotatably positioned in-between the first side handle and the second side handle. The pusher has a hollow housing that can receive a terminal end of a spark plug, and further has a first arm and a second arm extending perpendicular away from the hollow housing. The first arm is rotatably positioned within the third connection opening of the first side handle, and the second arm is rotatably positioned within the third connection opening of the second side handle. The spark plug gapping tool further includes a first connector and a second connector. The first connector is positioned within the first connection opening of the first side handle, the first connection opening of the second side handle, and the first connection opening of the middle handle. The first connector connects the middle handle in-between the first side handle and the second side handle. The second connector is positioned within the second connection opening of the first side handle and the second connection opening of the second side handle. The second connector connects the proximal end of the first side handle to the proximal end of the second side handle. In operation, the distal end of the middle handle and the distal ends of the first side handle and the second side handle can move closer together, when the proximal end of the middle handle and the proximal ends of the first side handle and the second side handle are moved closer together by a user's hand, so as to gap the spark plug.

Certain examples of the disclosure may provide one or more technical advantages. For example, each of the first side handle, the second side handle, the middle handle, and the pusher may be made of a non-metallic material. Such a non-metallic material allows the spark plug gapping tool to be lightweight, allowing a user to utilize the tool with only one of the user's hands, in some examples. Also, the non-metallic material further prevents damage to the spark plug, in some examples. In another example, each of the first side handle, the second side handle, the middle handle, and the pusher may be made using 3D printing, or may be made using any other additive manufacturing method. As such, the spark plug gapping tool may be easier to manufacture, in some examples.

Certain examples of the disclosure may include none, some, or all of the above technical advantages. One or more other technical advantages may be readily apparent to one skilled in the art from the figures, descriptions, and claims included herein.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Figure 1A:
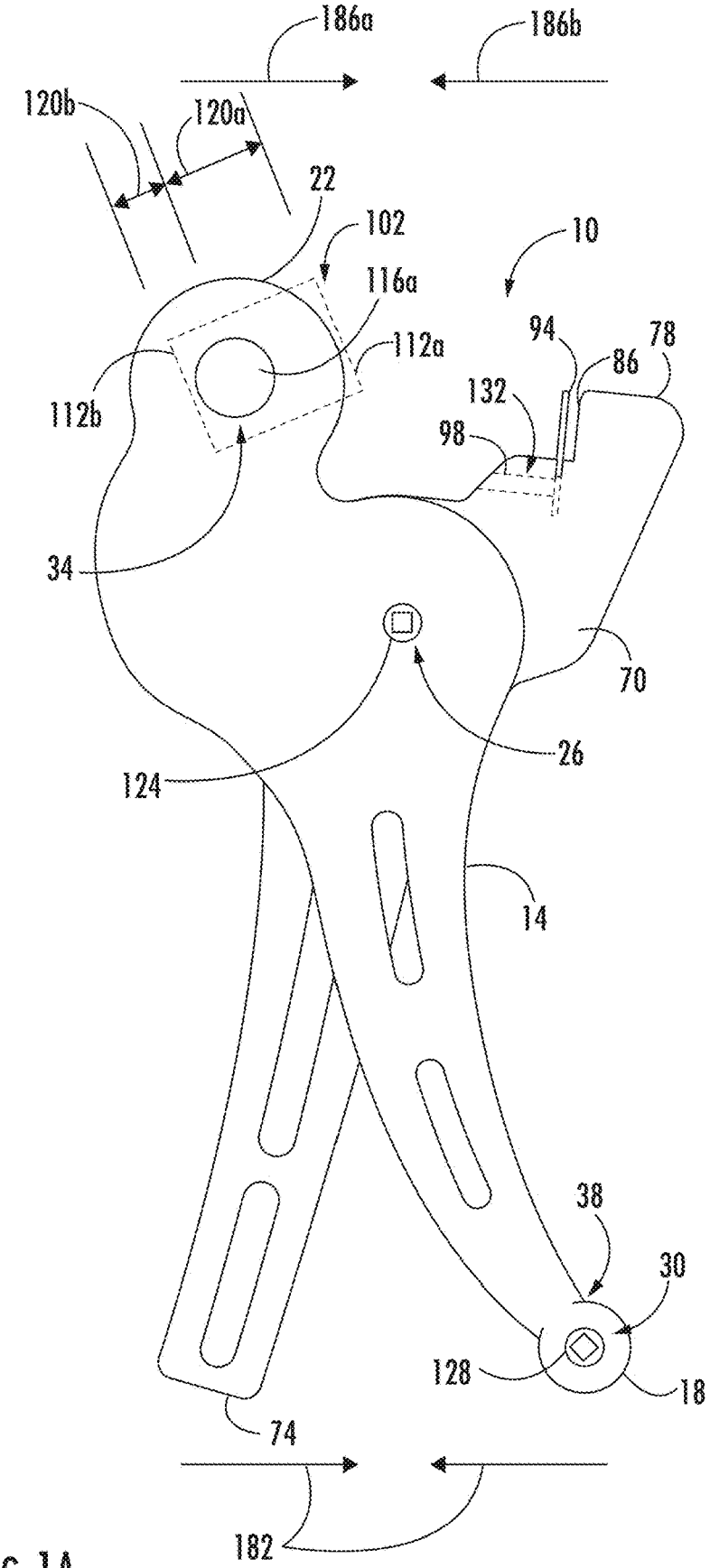
FIG. 1A is a side view of one example of a spark plug gapping tool.

Embodiments of the present disclosure are best understood by referring to FIGS. 1A-3 of the drawings, like numerals being used for like and corresponding parts of the various drawings.

A spark plug is a device that produces a spark for igniting a combustible mixture (e.g., a compressed fuel/air mixture in an engine of an automobile). This spark is produced when an electrical current flows from a center electrode to a side electrode, across a spark plug gap in-between the center electrode and the side electrode. The distance of this spark plug gap (i.e., the distance between the center electrode and the side electrode) is important to the operation of the spark plug. Furthermore, this spark plug gap distance frequently needs to be changed prior to the spark plug being installed. This process of changing the spark plug gap distance is referred to as gapping the spark plug. Unfortunately, traditional methods and tools for gapping a spark plug may be deficient. For example, a spark plug may be gapped manually using a feeler gauge, and by manually applying pressure to the side electrode of the spark plug. This, however, may be time consuming because the entire process needs to be repeated for each spark plug (even if all the spark plugs have the same size gap requirement). As another example, traditional tools for gapping a spark plug tend to be bulky and heavy. This requires a user to use both of their hands to gap the spark plug. These traditional tools are also made of metal, which may damage the insulator of the spark plug. Contrary to such typical deficiencies, the spark plug gapping tool 10 of FIGS. 1A-1F may provide one or more advantages, as is discussed below.

FIGS. 1A-1F illustrate an example spark plug gapping tool 10 that may be used to gap a spark plug 150. As is illustrated in FIGS. 1A-1F, the tool 10 includes a first side handle 14, a second side handle 42, a middle handle 70 positioned in-between the first side handle 14 and the second side handle 42, and a pusher 102 rotatably positioned in-between the first side handle 14 and the second side handle 42. In the illustrated example, these parts of the tool 10 are each made of a non-metallic material (e.g., carbon fiber). Such a non-metallic material may allow the tool 10 to be lightweight, allowing a user to utilize the tool 10 with only one of the user's hands, in some examples. Also, the non-metallic material may further prevent damage to the spark plug 150, in some examples.

Figure 1B:
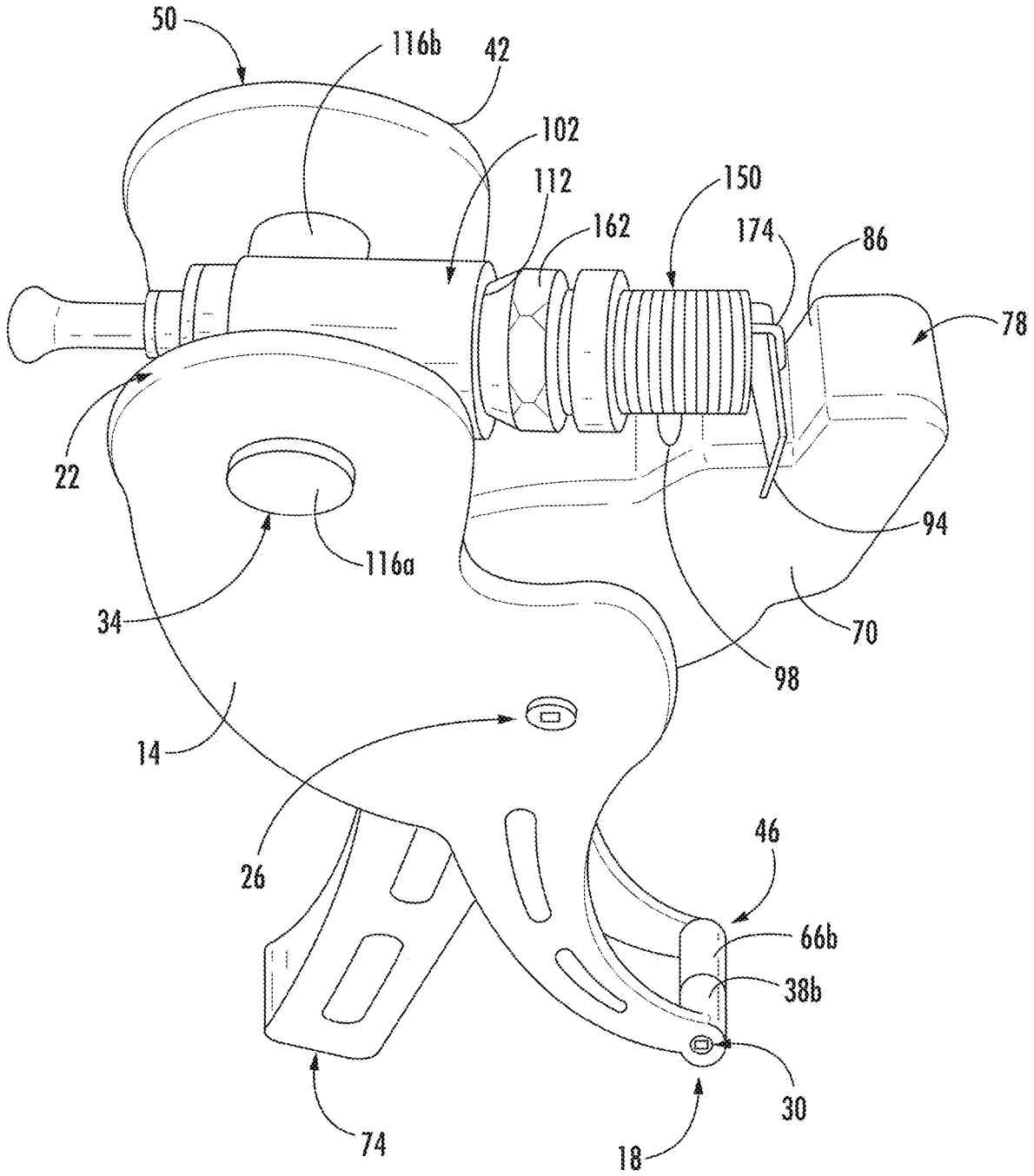
FIG. 1B is an elevated perspective view of the example tool of FIG. 1A, with a spark plug inserted into the tool.
Figure 1C:
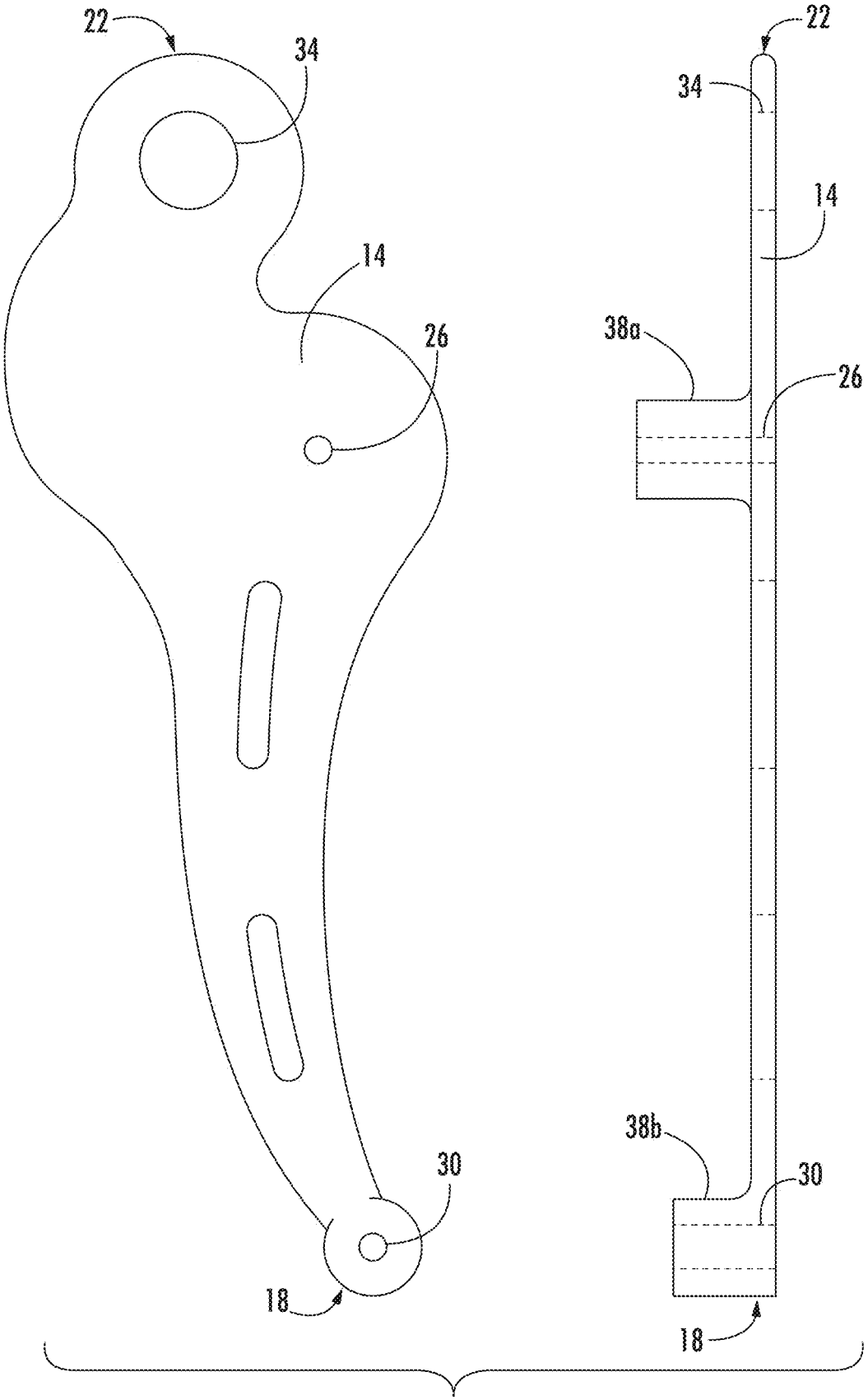
FIG. 1C is a side view and a front view of one example of the first side handle of the example tool of FIG. 1A.

In the example illustrated in FIGS. 1A-1B, the tool 10 includes a first side handle 14. FIG. 1C illustrates a side view and a front view of this first side handle 14. The first side handle 14 may be any structure that may be gripped by a user, and that may further be used to apply pressure to a spark plug 150. In the example illustrated in FIGS. 1A-1C, the first side handle 14 extends from a proximal end 18 to a distal end 22. The proximal end 18 refers to the end of the first side handle 14 that is closest to a user's hand when the user is holding the tool 10. The distal end 22 refers to the end of the first side handle 14 that is furthest from the user's hand when the user is holding the tool 10.

In the example illustrated in FIGS. 1A-1C, the first side handle 14 further includes a first connection opening 26, a second connection opening 30, and a third connection opening 34. The first connection opening 26 may be any opening that extends entirely through a thickness of the first side handle 14, and that may allow a first connector 124 to be inserted through the opening to couple each of the first side handle 14, the second side handle 42, and the middle handle 70 together. In the example illustrated in FIGS. 1A-1C, the first connection opening 26 is positioned at a location on the first side handle 14 that operates as the pivot point of the tool 10. This causes the first side handle 14 to rotate (or otherwise pivot) around this location when the tool 10 is in use, in some examples. The first connection opening 26 may have any size and/or shape. In the example illustrated in FIGS. 1A-1C, the first connection opening 26 is shaped as a circle.

The second connection opening 30 may be any opening that extends entirely through a thickness of the first side handle 14, and that may allow a second connector 128 to be inserted through the opening to couple each of the first side handle 14 and the second side handle 42 together. In the example illustrated in FIGS. 1A-1C, the second connection opening 30 is positioned at a location that is adjacent to (i.e., within 2 inches of) the proximal end 18 of the first side handle 14. This allows the first side handle 14 and the second side handle 42 to be coupled together at a location that does not interfere with the movement of the tool 10, in some examples. For example, this location allows the proximal end 18 of the first side handle 14 to be squeezed toward the proximal end 74 of the middle handle 70, without interfering with this movement. The second connection opening 30 may have any size and/or shape. In the example illustrated in FIGS. 1A-1C, the second connection opening 30 is shaped as a circle.

The third connection opening 34 may be any opening that extends entirely through a thickness of the first side handle 14, and that may allow a pusher 102 to be inserted through the opening so as to be rotatably positioned in-between the first side handle 14 and the second side handle 42. In the example illustrated in FIGS. 1A-1C, the third connection opening 34 is positioned at a location that is adjacent to (i.e., within 2 inches of) the distal end 22 of the first side handle 14. This allows the pusher 102 to align the spark plug 150 with the stopper surface 86 of the middle handle 70, so that the spark plug 150 can be gapped, in some examples. The third connection opening 34 may have any size and/or shape. In the example illustrated in FIGS. 1A-1C, the third connection opening 34 is shaped as a circle.

The first side handle 14 may have any size and/or shape. In the example illustrated in FIGS. 1A-1C, the first side handle 14 is shaped so that the proximal end 18 curves outward away from the first connection opening 26 (and the pivot point of the tool 10). This curvature may allow the tool 10 to be more easily gripped by a user.

Additionally, the shape of the first side handle 14 may also include one or more standoff protrusions 38. The standoff protrusion 38 may be a structure that extends perpendicularly away from the main body of the first side handle 14. Furthermore, the standoff protrusions 38 may surround a connection opening, causing the connection opening to extend through the entire length of the standoff protrusion 38. In the example illustrated in FIGS. 1A-1B, a first standoff protrusion **38*a* surrounds the first connection opening 26 and a second standoff protrusion 38*b* surrounds the second connection opening 30, causing the connection openings 26, 30 to extend through the entire length of the standoff protrusions 38. When the tool 10 is assembled, the standoff protrusion(s) 38 of the first side handle 14 may be in contact with the standoff protrusion(s) 66 of the second side handle 42. As such, the first side handle 14 may touch (or otherwise be in contact) with the second side handle 42, even though the middle handle 70 is positioned in-between the first side handle 14 and the second side handle 42. This may provide additional stability to the tool 10. One example of this touching is illustrated in FIG. 1B**.

The first side handle 14 may be made of any material that allows it to be used to gap the spark plug 150. For example, the first side handle 14 may be made of any non-metallic material that is strong enough to be used to gap the spark plug 150. Examples of such a non-metallic material include carbon fiber, basalt fiber, Kevlar, any other strong non-metallic material, or any combination of the preceding. In some examples, the first side handle 14 may be 3D printed using a 3D printer, or may be made using any other additive manufacturing method. 3D printing refers to the construction of a three-dimensional object from a computer-aided design (CAD) model or a digital 3D model. In 3D printing, material is deposited, joined or solidified under computer control to create a three-dimensional object, with material being added together (such as liquids or powder grains being fused together), typically layer by layer. Examples of a 3D printer include the Stratasys Fortus 450MC, the Stacker S4 Industrial Grade 3D Printer, the Ultimaker S5, and the Markforged X7. Furthermore, although the first side handle 14 is described above as being made of a non-metallic material, in other examples it may be made of metal (e.g., steel, billet aluminum).

Figure 1D:
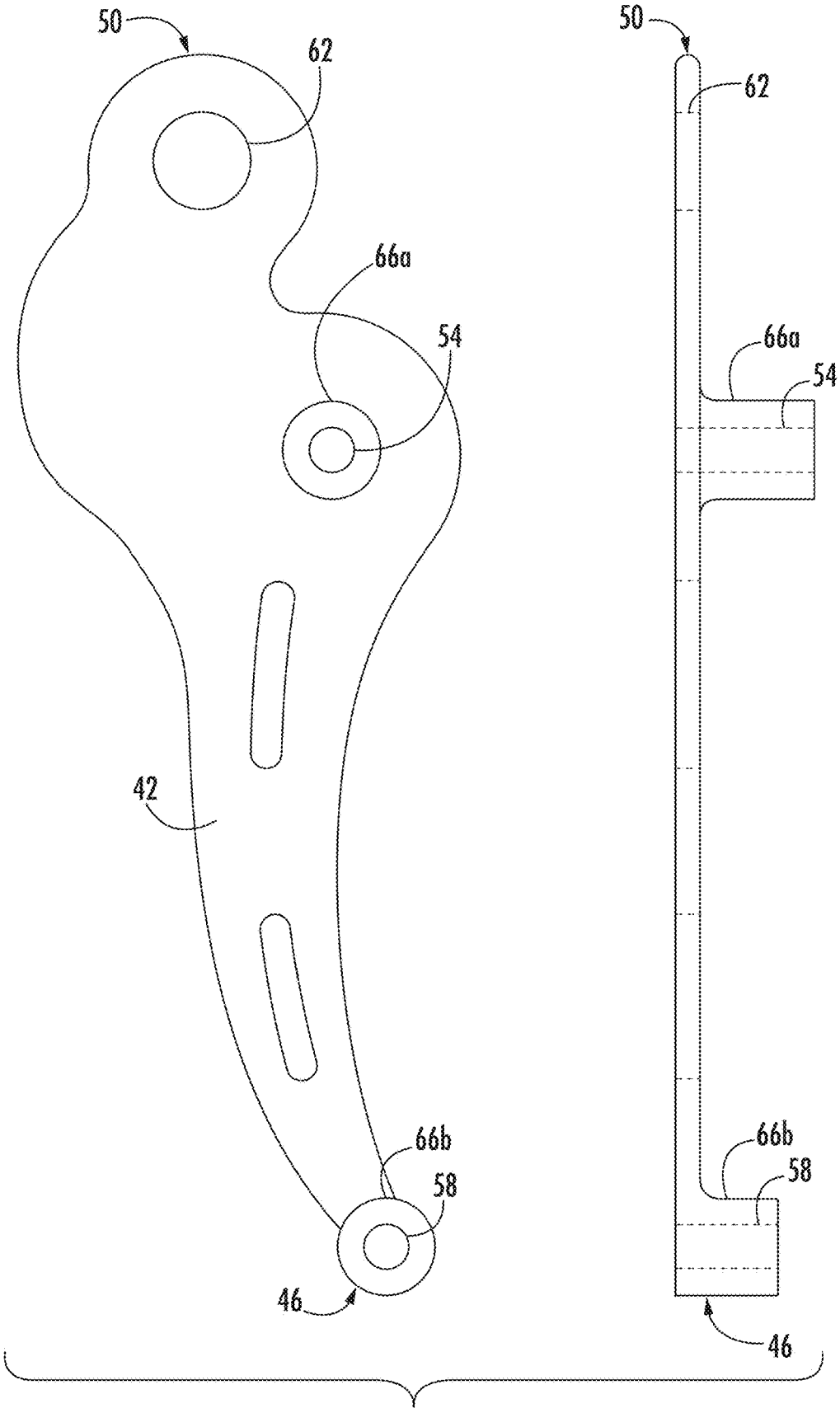
FIG. 1D is a side view and a front view of one example of the second side handle of the example tool of FIG. 1A.

In the example illustrated in FIGS. 1A-1B, the tool 10 further includes the second side handle 42. FIG. 1D illustrates a side view and a front view of this second side handle 42. The second side handle 42 may be any structure that may be gripped by a user, and that may further be used to apply pressure to a spark plug 150. In the example illustrated in FIGS. 1A-1B and 1D, the second side handle 42 extends from a proximal end 46 to a distal end 50. The proximal end 46 refers to the end of the second side handle 42 that is closest to a user's hand when the user is holding the tool 10. The distal end 50 refers to the end of the second side handle 42 that is furthest from the user's hand when the user is holding the tool 10.

In the example illustrated in FIGS. 1A-1B and 1D, the second side handle 42 further includes a first connection opening 54, a second connection opening 58, and a third connection opening 62. The first connection opening 54 may be any opening that extends entirely through a thickness of the second side handle 42, and that may allow a first connector 124 to be inserted through the opening to couple each of the first side handle 14, the second side handle 42, and the middle handle 70 together. In the example illustrated in FIGS. 1A-1B and 1D, the first connection opening 54 is positioned at a location on the second side handle 42 that operates as the pivot point of the tool 10. This causes the second side handle 42 to rotate (or otherwise pivot) around this location when the tool 10 is in use, in some examples. The first connection opening 54 may have any size and/or shape. In the example illustrated in FIGS. 1A-1B and 1D, the first connection opening 54 is shaped as a circle.

The second connection opening 58 may be any opening that extends entirely through a thickness of the second side handle 42, and that may allow a second connector 128 to be inserted through the opening to couple each of the first side handle 14 and the second side handle 42 together. In the example illustrated in FIGS. 1A-1B and 1D, the second connection opening 58 is positioned at a location that is adjacent to (i.e., within 2 inches of) the proximal end 46 of the second side handle 42. This allows the second side handle 42 and the first side handle 14 to be coupled together at a location that does not interfere with the movement of the tool 10, in some examples. For example, this location allows the proximal end 46 of the second side handle 42 to be squeezed toward the proximal end 74 of the middle handle 70, without interfering with this movement. The second connection opening 58 may have any size and/or shape. In the example illustrated in FIGS. 1A-1B and 1D, the second connection opening 58 is shaped as a circle.

The third connection opening 62 may be any opening that extends entirely through a thickness of the second side handle 42, and that may allow a pusher 102 to be inserted through the opening so as to be rotatably positioned in-between the first side handle 14 and the second side handle 42. In the example illustrated in FIGS. 1A-1B and 1D, the third connection opening 62 is positioned at a location that is adjacent to (i.e., within 2 inches of) the distal end 50 of the second side handle 42. This allows the pusher 102 to align the spark plug 150 with the stopper surface 86 of the middle handle 70, so that the spark plug 150 can be gapped, in some examples. The third connection opening 62 may have any size and/or shape. In the example illustrated in FIGS. 1A-1B and 1D, the third connection opening 62 is shaped as a circle.

The second side handle 42 may have any size and/or shape. In the example illustrated in FIGS. 1A-1B and 1D, the second side handle 42 is shaped so that the proximal end 46 curves outward away from the first connection opening 54 (and the pivot point of the tool 10). This curvature may allow the tool 10 to be more easily gripped by a user.

Additionally, the shape of the second side handle 42 may also include one or more standoff protrusions 66. The standoff protrusion 66 may be a structure that extends perpendicularly away from the main body of the second side handle 42. Furthermore, the standoff protrusion 66 may surround a connection opening, causing the connection opening to extend through the entire length of the standoff protrusion 66. In the example illustrated in FIGS. 1A-1B and 1D, a first standoff protrusion 66*a* surrounds the first connection opening 54 and a second standoff protrusion 66*b* surrounds the second connection opening 58, causing the connection openings 54, 58 to extend through the entire length of the standoff protrusions 66. When the tool 10 is assembled, the standoff protrusion(s) 66 of the second side handle 42 may be in contact with the standoff protrusion(s) 38 of the first side handle 14 (e.g., the ends of the standoff protrusion(s) 66 may touch the ends of the standoff protrusion(s) 38). As such, the second side handle 42 may touch (or otherwise be in contact) with the first side handle 14, even though the middle handle 70 is positioned in-between the second side handle 42 and the first side handle 14. This may provide additional stability to the tool 10. One example of this touching is illustrated in FIG. 1B.

The second side handle 42 may be made of any material that allows it to be used to gap the spark plug 150. For example, the second side handle 42 may be made of any non-metallic material that is strong enough to be used to gap the spark plug 150. Examples of such a non-metallic material include carbon fiber, basalt fiber, Kevlar, any other strong non-metallic material, or any combination of the preceding. In some examples, the second side handle 42 may be 3D printed using a 3D printer, or may be made using any other additive manufacturing method. Furthermore, although the second side handle 42 is described above as being made of a non-metallic material, in other examples it may be made of metal (e.g., steel, billet aluminum).

In the example illustrated in FIGS. 1A-1B and 1D, the second side handle 42 and the first side handle 14 are mirror images of each other. That is, the second side handle 42 and the first side handle 14 have the same components, the same shape, the same size, and are made of the same material, but they are configured to face each other, as is seen in FIG. 1B. This may allow the second side handle 42 and the first side handle 14 to be connected together (via connection openings 34, 38, 54, and 58) to form a single lever. This single lever may then be squeezed toward the middle handle 70 (by a user's hand), so as to operate the tool 10. In some examples, by separating this lever into two portions (i.e., the first side handle 14 and the second side handle 42), less material may be needed to form the lever (as most of it may be filled with empty space). This may further reduce the weight of the tool 10.

Figure 1E:
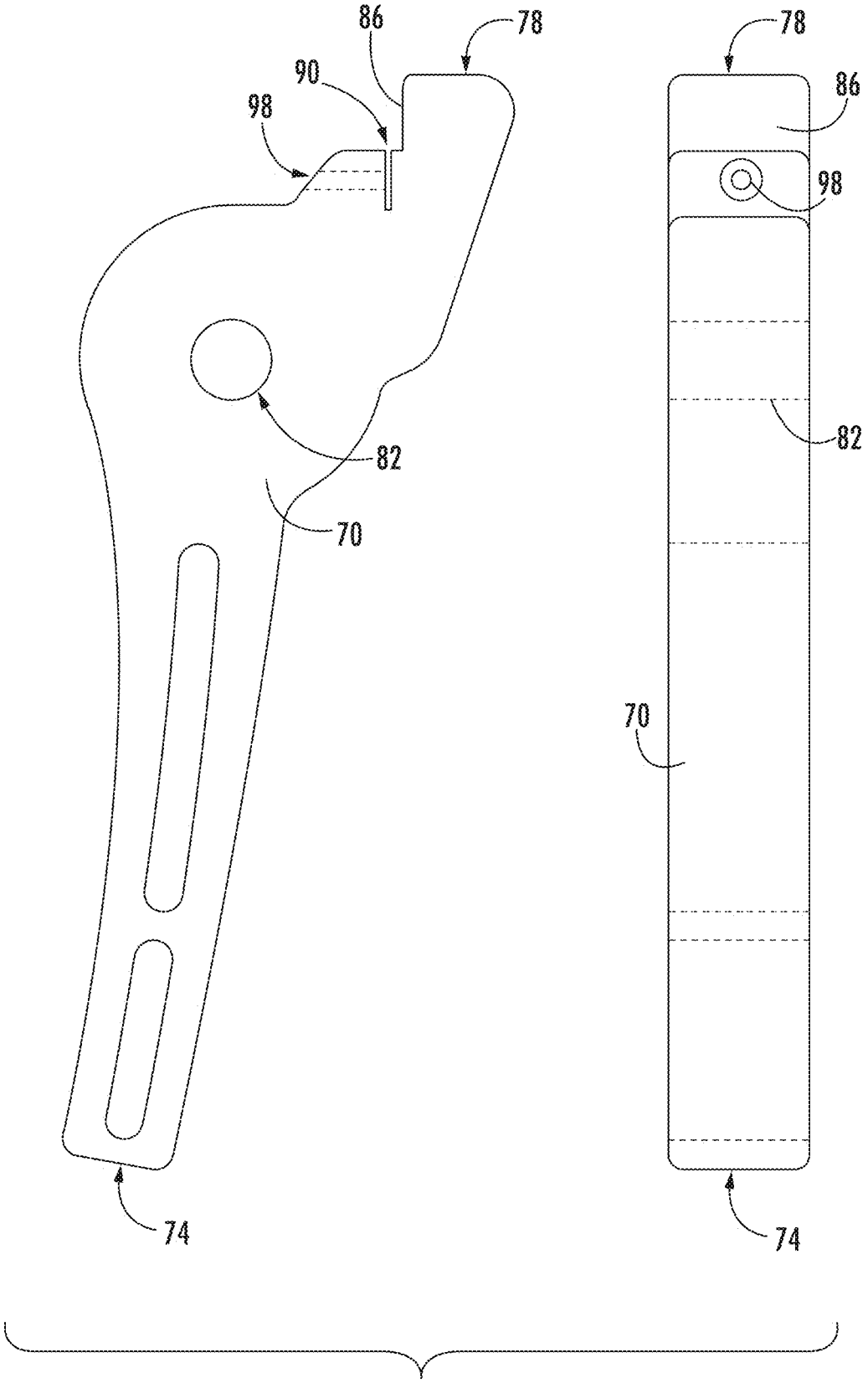
FIG. 1E is a side view and a front view of one example of the middle handle of the example tool of FIG. 1A.

In the example illustrated in FIGS. 1A-1B, the tool 10 further includes the middle handle 70 positioned in-between the first side handle 14 and the second side handle 42. FIG. 1E illustrates a side view and a front view of this middle handle 70. The middle handle 70 may be any structure that may be gripped by a user, and that may further be used to apply pressure to a spark plug 150. In the example illustrated in FIGS. 1A-1B and 1E, the middle handle 70 extends from a proximal end 74 to a distal end 78. The proximal end 74 refers to the end of the middle handle 70 that is closest to a user's hand when the user is holding the tool 10. The distal end 78 refers to the end of the middle handle 70 that is furthest from the user's hand when the user is holding the tool 10.

In the example illustrated in FIGS. 1A-1B and 1E, the middle handle 70 further includes a first connection opening 82, a stopper surface 86, an insert slot 90, and an insert connection opening 98. The first connection opening 82 may be any opening that extends entirely through a thickness of the middle handle 70, and that may allow a first connector 124 to be inserted through the opening to couple each of the first side handle 14, the second side handle 42, and the middle handle 70 together. In some examples, the first connection opening 82 may further allow a first standoff protrusion 38*a* of the first side handle 14 and a first standoff protrusion 66*a* of the second side handle 42 to be inserted through the opening from opposite sides. As such, the ends of the standoff protrusions 38*a* and 66*a* may touch each other within the first connection opening 82, even though the middle handle 70 is positioned in-between the first side handle 14 and the second side handle 42. In the example illustrated in FIGS. 1A-1B and 1E, the first connection opening 82 is positioned at a location on the middle handle 70 that operates as the pivot point of the tool 10. This causes the middle handle 70 to rotate (or otherwise pivot) around this location when the tool 10 is in use, in some examples. The first connection opening 82 may have any size and/or shape. In the example illustrated in FIGS. 1A-1B and 1E, the first connection opening 82 is shaped as a circle.

The stopper surface 86 may be any surface that is positioned on the middle handle 70 in a location that allows the stopper surface 86 to apply pressure to a side electrode 174 of the spark plug 150, so as to gap the spark plug 150. In the example illustrated in FIGS. 1A-1B and 1E, the stopper surface 86 is positioned at a location that is adjacent to (i.e., within 2 inches of) the distal end 78 of the middle handle 70. This allows the pusher 102 to align the spark plug 150 with the stopper surface 86 of the middle handle 70, so that the spark plug 150 can be gapped, in some examples. For example, this allows the pusher 102 to align the side electrode 174 of the spark plug 150 so that it is positioned against the stopper surface 86. As such, the stopper surface 86 may apply pressure to the side electrode 174 of the spark plug 150, when the tool 10 is in use, so as to gap the spark plug 150. The stopper surface 86 may have any size and/or shape. In the example illustrated in FIGS. 1A-1B and 1E, the stopper surface 86 is shaped as a flat surface. In other examples, it may be rounded, or have any other shape. The stopper surface 86 may be angled relative to the middle handle 70. In the example illustrated in FIGS. 1A-1B and 1E, the stopper surface 86 is angled so as to extend upwards at an angle that is parallel or substantially parallel (i.e., parallel+/−10 degrees) to the insert slot 90.

The insert slot 90 may be any slot or opening that allows a feeler gauge insert 94 to be inserted into the insert slot 90, so as to attach the feeler gauge insert 94 to the tool 10. In the example illustrated in FIGS. 1A-1B and 1E, the insert slot 90 is positioned at a location that is immediately adjacent to (i.e., within 10 millimeters of) the stopper surface 86. This allows the spark plug 150 to be positioned in the tool 10 in a manner that allows the feeler gauge insert 94 to be positioned in-between the center electrode 170 and the side electrode 174 of the spark plug 150. As such, the feeler gauge insert 94 can be used to gap the spark plug 150. The insert slot 90 may have any size and/or shape. In the example illustrated in FIGS. 1A-1B and 1E, the insert slot 90 is shaped as a slot that extends downward to (or past) the insert connection opening 98.

The feeler gauge insert 94 (an example of which is shown in FIG. 1B) may be any structure that can be inserted into the tool 10 so as to measure the clearance between the center electrode 170 and the side electrode 174 of the spark plug 150. Furthermore, the feeler gauge insert 94 may also prevent the spark plug 150 from being over gapped. That is, it may prevent the side electrode 174 from being moved too close to the center electrode 170 of the spark plug 150. The feeler gauge inset 94 may have any thickness. This thickness may correspond to the proper gap of a spark plug 150. For example, if the spark plug 150 is supposed to be gapped to a measurement of 1 millimeter, the feeler gauge insert 94 may have a thickness of 1 millimeter. In the example illustrated in FIGS. 1A-1B and 1E, the feeler gauge insert 94 may be replaceable. That is, a feeler gauge insert 94 having a first thickness (e.g., 1 millimeter) may be removed from the tool 10, and a new feeler gauge insert having a second thickness (e.g., 1.5 millimeters) may be inserted onto the tool 10. This may allow the user to properly gap a spark plug 150 to any gap distance, in some examples. In some examples, the feeler gauge insert 94 has an opening in its bottom portion to allow the third connector 132 to be inserted through all or a portion of the thickness of the feeler gauge insert 94. This may assist in coupling the feeler gauge insert 94 in the insert slot 90.

The insert connection opening 98 may be any opening that extends through a portion of the middle handle 70 to connect with the insert slot 90, and that may allow a third connector 132 to be inserted through the opening to couple the feeler gauge insert 94 in the insert slot 90. The insert connection opening 98 may have any size and/or shape. In the example illustrated in FIGS. 1A-1B and 1E, the insert connection opening 98 is shaped as a circle.

The middle handle 70 may have any size and/or shape. In the example illustrated in FIGS. 1A-1B and 1E, the middle handle 70 is shaped so that the proximal end 74 curves outward away from the first connection opening 82 (and the pivot point of the tool 10). This curvature may allow the tool 10 to be more easily gripped by a user. As is illustrated in FIG. 1A, the proximal end 74 curves outward away from the first connection opening 82 in a direction that is opposite of the curvature of the first side handle 14 and the second side handle 42.

The middle handle 70 may be made of any material that allows it to be used to gap the spark plug 150. For example, the middle handle 70 may be made of any non-metallic material that is strong enough to be used to gap the spark plug 150. Examples of such a non-metallic material include carbon fiber, basalt fiber, Kevlar, any other strong non-metallic material, or any combination of the preceding. In some examples, although the middle handle 70 may be made of a non-metallic material, the stopper surface 86 may include a metal insert that may be added to the tool 10 (e.g., pressed into the stopper surface 86, inserted into a small indent in the stopper surface 86). This metal insert in the stopper surface 86 may apply pressure to the side electrode 174 of the spark plug 150, when the tool 10 is in use, so as to gap the spark plug 150. This metal insert may provide additional durability to the stopper surface 86. In some examples, the middle handle 70 may be 3D printed using a 3D printer, or may be made using any other additive manufacturing method. Furthermore, although the middle handle 70 is described above as being made of a non-metallic material, in other examples it may be made of metal (e.g., steel, billet aluminum).

Figure 1F:
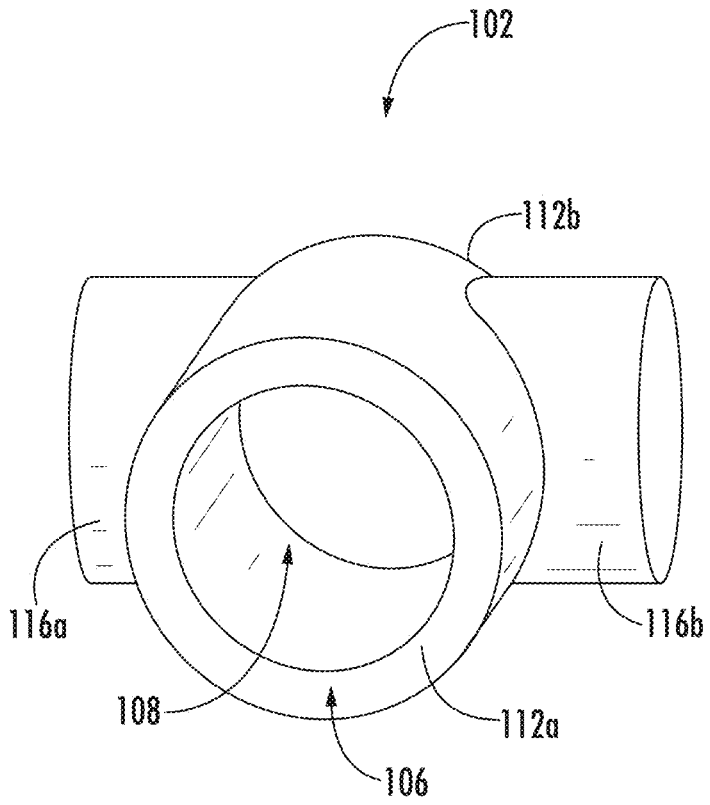
FIG. 1F is a perspective view of one example of a pusher of the example tool of FIG. 1A.

In the example illustrated in FIGS. 1A-1B, the tool 10 further includes the pusher 102 rotatably positioned in-between the first side handle 14 and the second side handle 42. FIG. 1F illustrates a perspective view of this pusher 102. The pusher 102 may be any structure that may receive a terminal end 158 of the spark plug 150, and that may further be used to apply pressure to a shell 162 of the spark plug 150, so as to assist in gapping the spark plug 150.

In the example illustrated in FIGS. 1A-1B and 1F, the pusher 102 includes a hollow housing 106 and two arms 116. The hollow housing 106 may be any structure that includes an opening 108 that extends entirely through a length of the structure, thereby hollowing out the structure. This opening 108 may allow the terminal end 158 of the spark plug 150 to be inserted through the hollow structure 106, as is seen in FIG. 1B. The opening 108 may have any size and/or shape. In the example illustrated in FIG. 1B, the opening 108 is a circular opening that has a diameter large enough to allow the terminal end 158 of the spark plug 150 to be inserted through the hollow structure 106, but small enough to prevent the shell 162 of the spark plug 150 from being inserted through the hollow structure 106. As a result of this, the edge 112 may press against the shell 162 of the spark plug 150. This allows the pusher 102 to be used to apply pressure to the shell 162 of the spark plug 150, so as to assist in gapping the spark plug 150.

The arm 116 may be any structure that extends outward from the hollow housing 106, and that can further be inserted into the third connection opening 34 of the first side handle 14 or the third connection opening 62 of the second side handle 42. In the example illustrated in FIGS. 1A-1B and 1F, the pusher 102 includes two arms 116: 116*a* and 116*b*. Arm 116*a* can be inserted into the third connection opening 34 of the first side handle 14, while arm 116*b* can be inserted into the third connection opening 62 of the first side handle 42, or vice versa.

The arm 116 may extend outward from the hollow housing 106 at any angle. In the example illustrated in FIGS. 1A-1B and 1E, the arm 116 extends outward from hollow housing 106 at an angle that causes it to be perpendicular (i.e., 90 degrees) to the hollow housing 106 and the opening 108. The arm 116 may also be positioned on the hollow housing 106 at any location along the length of the hollow housing 106. For example, the arms 116 may positioned at a location that is closer to the edge 112*b* of the hollow housing 106 than the edge 112*a* of the hollow housing 106. In the example illustrated in FIGS. 1A-1B and 1F, the arms 116 are positioned at a location that causes the outermost dimension of the arms 116 to be in-line with (or substantially in-line with) the edge 112*b*. This may cause the hollow housing 106 to have a first length portion 120*a* that is longer than the second length portion 120*b*, in some examples. As such, the hollow housing 106 may be used to fit spark plugs 150 that have different lengths. If the spark plug 150 has a shorter electrode end 166, the hollow housing 106 may be pivoted so that edge 112*a* presses against the shell 162 of the spark plug 150, as is seen in FIG. 1B. On the other hand, if the spark plug 150 has a longer electrode end 166, the hollow housing 106 may be pivoted so that edge 112*b* presses against the shell 162 of the spark plug 150.

The arm 116 may have any size and/or shape. The arm 116 is shaped as a circle, in the example illustrated in FIGS. 1A-1B and 1E. This circular shape of the arms 116, in combination with the circular shape of the third connections 34 and 62, allows the pusher 102 to rotate while the pusher 102 is positioned in-between the first side handle 14 and the second side handle 42, in some examples. Such rotation allows the hollow housing 106 to be pivoted for insertion of the spark plug 150, and then pivoted back for gapping the spark plug 150. This rotation may also allow the hollow housing 106 to be rotated around so that edge 112*b* or edge 112*a* faces the shell 162 of the spark plug 150, so that the hollow housing 106 can be used to fit spark plugs 150 that have different lengths.

The pusher 102 may have any size and/or shape. Furthermore, the pusher 102 may be made of any material that allows it to be used to gap the spark plug 150. For example, the pusher 102 may be made of any non-metallic material that is strong enough to be used to gap the spark plug 150. Examples of such a non-metallic material include carbon fiber, basalt fiber, Kevlar, any other strong non-metallic material, or any combination of the preceding. In some examples, the pusher 102 may be 3D printed using a 3D printer, or may be made using any other additive manufacturing method. Furthermore, although the pusher 102 is described above as being made of a non-metallic material, in other examples it may be made of metal (e.g., steel, billet aluminum).

In the example illustrated in FIGS. 1A-1B and 1E, the pusher 102 may be replaceable. That is, a pusher 102 having a first size (e.g., having a smaller sized opening 108) may be removed from the tool 10, and a new pusher 102 having a second size (e.g., having a larger sized opening 108) may be inserted onto the tool 10. This may allow the tool 10 to be used to gap spark plugs 150 having different thicknesses (e.g., it may be used to gap standard sized spark plugs 150 and also spark plugs 150 for a HEMI engine).

In the example illustrated in FIGS. 1A-1B, the tool 10 further includes the first connector 124 positioned within the first connection opening 26 of the first side handle 14, the first connection opening 54 of the second side handle 42, and the first connection opening 82 of the middle handle 70. The first connecter 124 may be any structure or device that couples the middle handle 70 in-between the first side handle 14 and the second side handle 42 in a manner that allows middle handle 70 to pivot in relation to the first side handle 14 and the second side handle 42. For example, the first connecter 124 may be a bolt, a screw, a pin, any other structure or device that couples the middle handle 70 in-between the first side handle 14 and the second side handle 42 in a manner that allows middle handle 70 to pivot in relation to the first side handle 14 and the second side handle 42, or any combination of the preceding. In the example illustrated in FIGS. 1A-1B, the first connecter 124 is a binding barrel and screw, such as a steel binding barrel and screw from MCMASTER-CARR.

The first connector 124 is a commercially available connector, in some examples. In other examples, the first connector 124 may be 3D printed using a 3D printer, or may be made using any other additive manufacturing method. The first connector 124 may be made of a non-metallic material (e.g., carbon steel) and/or a metallic material (e.g., steel, billet aluminum).

In the example illustrated in FIGS. 1A-1B, the tool 10 further includes the second connector 128 positioned within the second connection opening 30 of the first side handle 14 and the second connection opening 58 of the second side handle 42. The second connector 128 may be any structure or device that couples the proximal end 18 of the first side handle 14 to the proximal end 46 of the second side handle 42 in a manner that prevents the proximal ends 18 and 46 from moving in relation to each other. For example, the second connector 128 may be a bolt, a screw, a pin, any other structure or device that couples the proximal end 18 of the first side handle 14 to the proximal end 46 of the second side handle 42 in a manner that prevents the proximal ends 18 and 46 from moving in relation to each other, or any combination of the preceding. In the example illustrated in FIGS. 1A-1B, the second connector 128 is a binding barrel and screw, such as a steel binding barrel and screw from MCMASTER-CARR.

The second connector 128 is a commercially available connector, in some examples. In other examples, the second connector 128 may be 3D printed using a 3D printer, or may be made using any other additive manufacturing method. The second connector 128 may be made of a non-metallic material (e.g., carbon steel) and/or a metallic material (e.g., steel, billet aluminum).

In the example illustrated in FIGS. 1A-1B, the tool 10 further includes the third connector 132 positioned within the insert connection opening 98. The third connector 132 may be any structure or device that couples that the feeler gauge insert 94 in the insert slot 90. For example, the third connector 132 may be a bolt, a screw, a pin, any other structure or device that couples that the feeler gauge insert 94 in the insert slot 90, or any combination of the preceding.

The third connector 132 is a commercially available connector, in some examples. In other examples, the third connector 132 may be 3D printed using a 3D printer, or may be made using any other additive manufacturing method. The second connector 128 may be made of a non-metallic material (e.g., carbon steel) and/or a metallic material (e.g., steel, billet aluminum).

Figure 2:
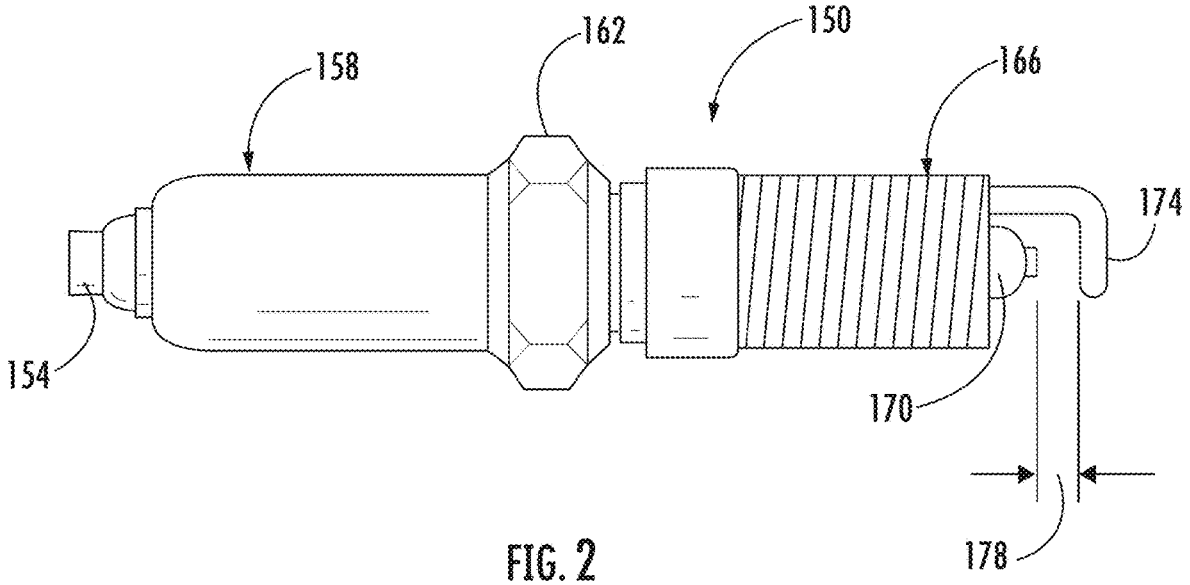
FIG. 2 is a side view of an example spark plug that may be gapped using the example spark plug gapping tool of FIG. 1A.

FIG. 2 is a side view of an example spark plug 150 that may be gapped using the example spark plug gapping tool 10 of FIG. 1A. The spark plug 150 is a device that produces a spark for igniting a combustible mixture (e.g., a compressed fuel/air mixture in an engine of an automobile). The spark plug 150 is a commercially available spark plug, in some examples. The spark plug 150 may be a spark plug for any device that utilizes a spark-ignition engine, such as an automobile or a lawn mower. As is illustrated, the spark plug 150 includes the terminal 154, the terminal end 158, the shell 162 (otherwise referred to as a hexagon), the electrode end 166, the center electrode 170 (otherwise referred to as a main electrode), the side electrode 174 (otherwise referred to as a ground strap, ground electrode, or side strap), and the spark plug gap 178 (otherwise referred to as an electrode gap). Different spark-ignition engines may require (or recommend) different spark plug gaps 178. For example, a first engine may require (or recommend) a spark plug gap 178 of 0.6 millimeters, while a second engine may require (or recommend) a spark plug gap 178 of 1.8 millimeters.

Figure 3:
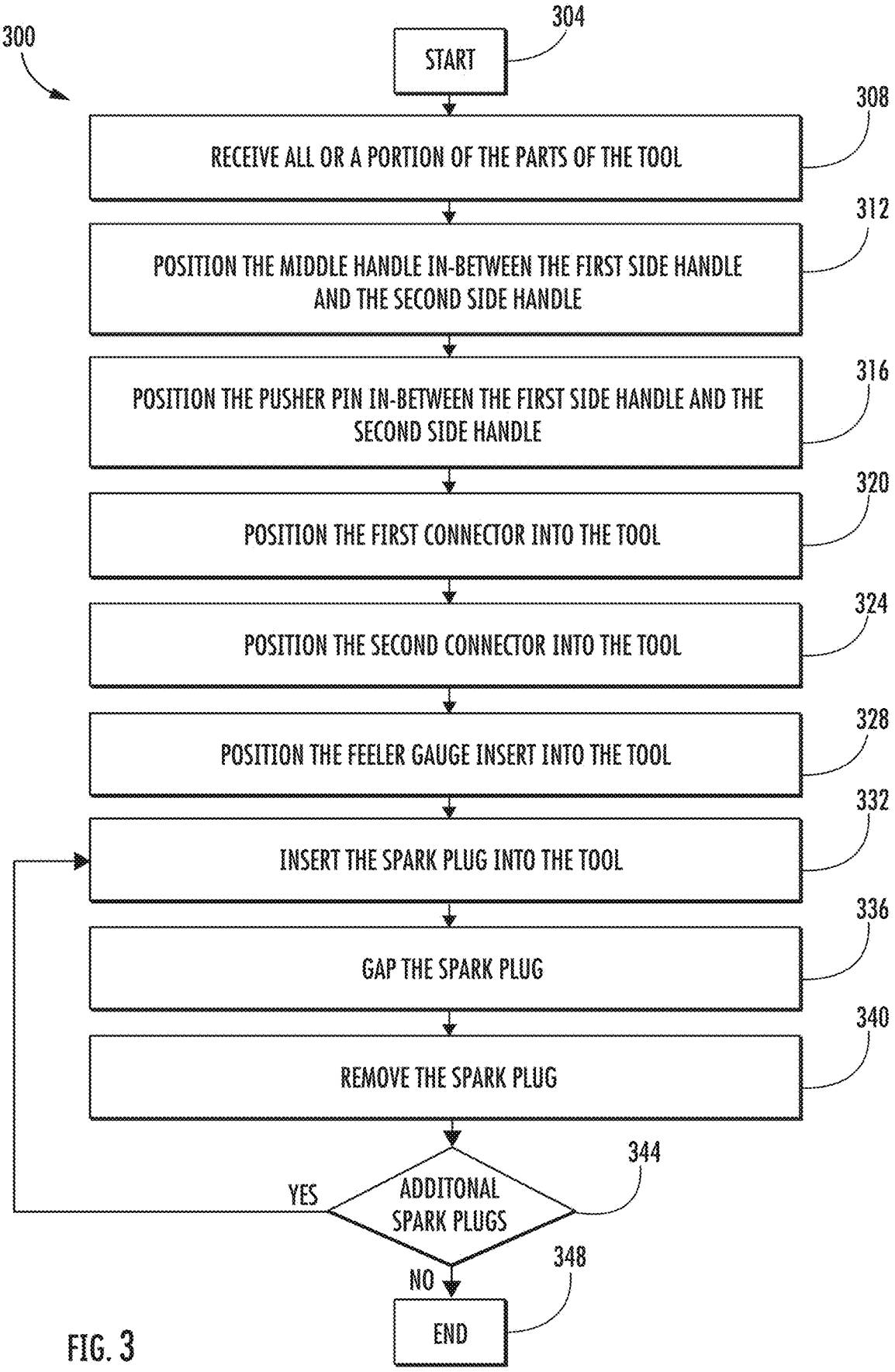
FIG. 3 illustrates one example of the assembly and operation of the spark plug gapping tool of FIG. 1A.

FIG. 3 illustrates one example of the assembly and operation of a spark plug gapping tool. The steps of method 300 are described as being performed using the spark plug gapping tool 10 of FIGS. 1A-1F and the spark plug 150 of FIG. 2. However, one or more of the steps (such as all of the steps) of method 300 may be performed using any other spark plug gapping tool and/or any other spark plug, in some examples. Furthermore, one or more of the steps (such as all of the steps) of method 300 may be performed by a manufacturer of a tool 10, a seller of a tool 10, a re-seller of a tool 10, and/or a user of a tool 10.

The method 300 begins at step 304. At step 308, a first side handle 14, a second side handle 42, a middle handle 70, and a pusher 102 are received. The first side handle 14, the second side handle 42, the middle handle 70, and the pusher 102 may be received in any manner. For example, the first side handle 14, the second side handle 42, the middle handle 70, and the pusher 102 may be received as a result of them being 3D printed. As another example, the first side handle 14, the second side handle 42, the middle handle 70, and the pusher 102 may be received as a result of them being purchased, delivered, retrieved from storage, received in any manner, or any combination of the preceding.

At step 312, the middle handle 70 is positioned in-between the first side handle 14 and the second side handle 42. In some examples, this positioning may cause both the first standoff protrusion **38*a* of the first side handle 14 and the first standoff protrusion 66*a* of the second side handle 42 to be positioned within the first connection opening 82 of the middle handle 70. That is, the first standoff protrusions 38*a*, 66*a* may be inserted into the first connection opening 82 of the middle handle 70** on opposite sides.

At step 316, the pusher 102 is positioned in-between the first side handle 14 and the second side handle 42. In some examples, this positioning may cause the first arm **116*a* to be rotatably positioned within the third connection opening 34 of the first side handle 14, and may further cause the second arm 116*b* to be rotatably positioned within the third connection opening 62 of the second side handle 42**.

At step 320, the first connector 124 is positioned within the first connection opening 26 of the first side handle 14, the first connection opening 54 of the second side handle 42, and the first connection opening 82 of the middle handle 70. As an example of this, the first connector 124 may be a bolt that inserted into the first connection openings 26, 54, 82. The first connector 124 may couple the middle handle 70 in-between the first side handle 14 and the second side handle 42. Furthermore, the first connector 124 may allow the middle handle 70 to pivot in relation to the first side handle 14 and the second side handle 42.

At step 324, the second connector 128 is positioned within the second connection opening 30 of the first side handle 14 and the second connection opening 58 of the second side handle 42. As an example of this, the second connector 128 may be a bolt that inserted into the second connection openings 30, 58. The second connector 128 may couple the proximal end 18 of the first side handle 14 to the proximal end 46 of the second side handle 42. This may prevent the proximal ends 18, 46 from moving in relation to each other, in some examples.

At step 328, the feeler gauge insert 94 is positioned into the insert slot 90 of the middle handle 70. To do so, a user may select (or create) a feeler gauge insert 94 to be used to gap the spark plug 150. For example, if an engine requires (or recommends) a spark plug gap 178 of 0.6 millimeters, the user selects (or creates) a feeler gauge insert 94 having a thickness of 0.6 millimeters. The user may then insert the feeler gauge insert 94 into the insert slot 90, and may then couple the feeler gauge insert 94 in the insert slot 90 by positioning the third connector 132 (e.g., a screw) into the insert connection opening 98.

At step 332, the spark plug 150 is inserted into the tool 10. To do so, the terminal end 158 of the spark plug 150 may be inserted into the pusher 102 (through the opening 108 of the hollow housing 106) so that the edge 112 of the hollow housing 106 presses against the shell 162 of the spark plug 150. Then, the spark plug 150 and the pusher 102 may be rotated downwards so that the feeler gauge insert 94 is positioned in-between the center electrode 170 and the side electrode 174 of the spark plug 150, and further so that the side electrode 174 is positioned in-between the feeler gauge insert 94 and the stopper surface 86. An example of this is illustrated in FIG. 1B.

At step 336, the spark plug 150 is gapped using the tool 10. To do so, a user may grip the middle handle 70 and the side handles 14, 42 in the user's hand, at a location adjacent to the proximal ends 18, 46, 74. Then the user may squeeze their grip, causing the proximal end 74 of the middle handle 70 to move closer to the proximal ends 18, 46 of the side handles 14, 42. This movement is illustrated at arrows 182 in FIG. 1A. As a result of this movement, the distal ends 22, 50 of the side handles 14, 42 move closer to the distal end 78 of the middle handle 70. This movement is illustrated at arrows 186 in FIG. 1A. The movement (shown in arrows 186) causes the spark plug 150 to be gapped. For example, as the distal ends 22, 50 of the side handles 14, 42 move towards the distal end 78 of the middle handle 70, the edge 112 of the pusher 102 applies pressure to the shell 162 of the spark plug 150, causing the spark plug 150 to move towards the stopper surface 86. This movement is illustrated at arrow 186*a* in FIG. 1A. At the same time, the stopper surface 86 (and the distal end 78 of the middle handle 70) moves towards the distal ends 22, 50 of the side handles 14, 42. As this occurs, the stopper surface 86 presses against the side electrode 174, causing it to bend (or otherwise move) towards the feeler gauge insert 94 and the center electrode 170. This movement is illustrated at arrow 186*b* in FIG. 1A. Thus, the movement causes the spark plug gap 178 to be reduced.

Eventually, the side electrode 174 may be bent (or otherwise moved) up against the feeler gauge insert 94, which prevents the side electrode 174 from bending (or otherwise moving) any further closer to the center electrode 170. When this occurs, the spark plug gap 178 is reduced to the thickness of the feeler gauge insert 94 (e.g., 0.6 millimeters), which is consistent with the required (or recommended) spark plug gap 178 for that engine (e.g., 0.6 millimeter).

At step 340, the spark plug 150 is removed from the tool 10. This may allow the spark plug 150 to be used, such as in an engine.

At step 344, it is determined whether additional spark plugs 150 should be gapped. If the answer is no, the method 300 moves to step 348, where the method 300 ends. Alternatively, if the answer is yes, the method 300 moves back up to step 332, where the new spark plug 150 is inserted into the tool 10. Then steps 332-344 may be repeated. Steps 332-344 may be repeated for any number of spark plugs 150. Furthermore, in some examples, additional spark plugs 150 may be gapped without a new feeler gauge insert 94 being inserted. The user may only need to insert a new feeler gauge insert 94 when a different spark plug gap 178 is required (or recommended). If that is the case, method 300 may include removing the old feeler gauge insert 94 (e.g., by removing the third connector 132 from the insert connection opening 98, and then removing the old feeler gauge insert 94), and then method 300 may re-perform step 328 with the new feeler gauge insert 94.

Furthermore, in some examples, the spark plug 150 may not fit within the pusher 102 because the spark plug 150 is too thick or not thick enough. In such examples, the old pusher 102 may be removed by dissembling all or a portion of the tool 10 (e.g., by removing the first connector 124, removing the second connector 128, and removing the old pusher 102), and then the new pusher 102 may be inserted into the tool 10 (and the tool 10 may be re-assembled) by re-performing steps 316-324.

Modifications, additions, or omissions may be made to method 300. For example, one or more of the steps of method 300 may be performed in parallel, or in a different order. As one example of this, the pusher 102 may be positioned in-between the first side handle 14 and the second side handle 42 (i.e., step 316), prior to or in parallel with the middle handle 70 being positioned in-between the first side handle 14 and the second side handle 42 (i.e., step 312).

Modifications, additions, combinations, or omissions may be made to the spark plug gapping tool 10 of FIGS. 1A-3 without departing from the scope of the disclosure. For example, the tool 10 may not include a second connector 128, and/or may not include one or more other elements described above.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification.

What is claimed is:

1. A spark plug gapping tool, comprising:

a first side handle and a second side handle each extending from a respective proximal end and a respective distal end, the proximal ends of the first and second side handles configured to be gripped by a user;

a middle handle pivotably coupled in-between the first and second side handles, the middle handle having a proximal end configured to be gripped by a user and a distal end including a stopper surface and an insert slot configured to receive a feeler gauge insert; and a pusher pivotably coupled in-between the distal ends of the first and second side handles, the pusher having a hollow housing configured to receive a terminal end of a spark plug;

wherein the distal end of the middle handle and the distal ends of the first and second side handles are configured to move closer together to reduce a distance between the pusher and the stopper surface when the proximal end of the middle handle and the proximal ends of the first and second side handles are moved closer together by a user's hand, so as to gap the spark plug.

2. The spark plug gapping tool of claim 1, wherein at least one of:

(a) the first and second side handles move as a unit;

(b) the proximal ends of the first and second side handles are connected by a connector; or (c) the positions of the first and second side handles are fixed relative to each other.

3. The spark plug gapping tool of claim 1, wherein the first side handle, the second side handle, the middle handle, and the pusher are each made of one or more non-metallic materials.

4. The spark plug gapping tool of claim 1, wherein the first side handle, the second side handle, the middle handle, and the pusher are each made of carbon fiber.

5. The spark plug gapping tool of claim 1, wherein the first side handle, the second side handle, the middle handle, and the pusher are each 3D printed.

6. The spark plug gapping tool of claim 1, wherein:

the first and second side handles both include a respective first standoff protrusion; and wherein the first standoff protrusion of the first side handle is positioned so as to touch the first standoff protrusion of the second side handle.

7. The spark plug gapping tool of claim 6, wherein the first standoff protrusion of the first side handle and the first standoff protrusion of the second side handle extend through an opening in the middle handle.

8. The spark plug gapping tool of claim 1, wherein the insert slot is configured to receive the feeler gauge insert having a first thickness, and further configured to receive a second feeler gauge insert having a second thickness that is bigger than the first thickness.

9. The spark plug gapping tool of claim 1, further comprising a second pusher having an opening that has a larger diameter than an opening of the pusher, wherein the spark plug gapping tool is configured to allow the pusher to be replaced with the second pusher.

10. The spark plug gapping tool of claim 1, wherein the first and second side handles are coupled together at a first position, and wherein the first and second side handles are further coupled together at a second position.

11. A spark plug gapping tool, comprising:

a first side handle extending from a proximal end to a distal end, the first side handle having a first connection opening, a second connection opening along the proximal end of the first side handle, and a third connection opening along the distal end of the first side handle, the first connection opening of the first side handle being positioned between the second and third connection openings of the first side handle;

a second side handle extending from a proximal end to a distal end, the second side handle having a first connection opening, a second connection opening along the proximal end of the second side handle, and a third connection opening along the distal end of the second side handle, the first connection opening of the second side handle being positioned between the second and third connection openings of the second side handle;

a middle handle extending from a proximal end to a distal end, the middle handle being positioned in-between the first side handle and the second side handle, the middle handle having:

a first connection opening;

a stopper surface; and an insert slot configured to receive a feeler gauge insert;

a first connector coupling the first side handle, the second side handle, and the middle handle at the respective first connections openings such that the middle handle is pivotable in-between the first side handle and the second side handle;

a second connector coupling the proximal ends of the first and second side handles at the respective second connection openings;

a pusher pivotably coupled in-between the distal ends of the first and second side handles at the respective third connection openings; and wherein the distal end of the middle handle and the distal ends of the first and second side handles are configured to move closer together to reduce a distance between the pusher and the stopper surface when the proximal end of the middle handle and the proximal ends of the first and second side handles are moved closer together by a user's hand, so as to gap the spark plug.

12. The spark plug gapping tool of claim 11, wherein at least one of:

(a) the first and second side handles move as a unit; or (b) the positions of the first and second side handles are fixed relative to each other.

13. The spark plug gapping tool of claim 11, wherein the first side handle, the second side handle, the middle handle, and the pusher are each made of one or more non-metallic materials.

14. The spark plug gapping tool of claim 11, wherein the first side handle, the second side handle, the middle handle, and the pusher are each made of carbon fiber.

15. The spark plug gapping tool of claim 11, wherein the first side handle, the second side handle, the middle handle, and the pusher are each 3D printed.

16. The spark plug gapping tool of claim 11, wherein:

the first and second side handles both include a respective first standoff protrusion; and wherein the first standoff protrusion of the first side handle is positioned so as to touch the first standoff protrusion of the second side handle.

17. The spark plug gapping tool of claim 16, wherein the first standoff protrusion of the first side handle and the first standoff protrusion of the second side handle extend through the first connection opening of the middle handle.

18. The spark plug gapping tool of claim 11, wherein the insert slot is configured to receive the feeler gauge insert having a first thickness, and further configured to receive a second feeler gauge insert having a second thickness that is bigger than the first thickness.

19. The spark plug gapping tool of claim 11, further comprising a second pusher having an opening that has a larger diameter than an opening of the pusher, wherein the spark plug gapping tool is configured to allow the pusher to be replaced with the second pusher.

* * * * *